US010145184B2

(12) United States Patent
Calderoni

(10) Patent No.: US 10,145,184 B2
(45) Date of Patent: Dec. 4, 2018

(54) ANTI-FRICTION DEVICE OF DRILLING ELEMENTS

(71) Applicant: DRILLMEC SPA, Gariga di Podenzano (PC) (IT)

(72) Inventor: Angelo Calderoni, Gariga di Podenzano (IT)

(73) Assignee: DRILLMEC SPA, Gariga di Podenzano (PC) (IT)

( * ) Notice: Subject to any disclaimer, the term of this patent is extended or adjusted under 35 U.S.C. 154(b) by 218 days.

(21) Appl. No.: 15/025,795

(22) PCT Filed: Sep. 12, 2014

(86) PCT No.: PCT/IB2014/064460

§ 371 (c)(1),
(2) Date: Mar. 29, 2016

(87) PCT Pub. No.: WO2015/044825

PCT Pub. Date: Apr. 2, 2015

(65) Prior Publication Data

US 2016/0356101 A1 Dec. 8, 2016

(30) Foreign Application Priority Data

Sep. 30, 2013 (IT) ..... TO2013A0778

(51) Int. Cl.
*E21B 17/10* (2006.01)

(52) U.S. Cl.
CPC ..... *E21B 17/1085* (2013.01); *E21B 17/1064* (2013.01)

(58) Field of Classification Search
CPC .... E21B 17/10; E21B 17/105; E21B 17/1064; E21B 17/1085; E21B 17/1078
See application file for complete search history.

(56) References Cited

U.S. PATENT DOCUMENTS 1,715,547 A 6/1929 Hardesty
1,764,769 A 6/1930 Woods
5,711,386 A * 1/1998 Swietlik ..... E21B 17/1064 175/325.3
9,217,301 B1 * 12/2015 Latham ..... E21B 17/1078

FOREIGN PATENT DOCUMENTS

GB 307212 3/1929
GB 2360305 A 9/2001

OTHER PUBLICATIONS

International Search Report and Written Opinion from International Application No. PCT/IB2014/064460, dated Jul. 27, 2015.

* cited by examiner

*Primary Examiner* — Brad Harcourt
*Assistant Examiner* — David Carroll
(74) *Attorney, Agent, or Firm* — Merchant & Gould P.C.

(57) ABSTRACT

An anti-friction device is associated with a drilling element, the drilling element having a substantially cylindrical shape, with a first outside diameter (d1) and a longitudinal extension along a first axis (X). The drilling element includes at least one housing for receiving the anti-friction device. The anti-friction device has a hollow cylindrical shape having an inside diameter (d) which is smaller than the first diameter (d1) of the drilling element and an outside diameter (D) which is greater than the first diameter (d1) of the drilling element. The anti-friction device is adapted to rotate about the first axis (X) in the housing, independently of the drilling element.

10 Claims, 8 Drawing Sheets

ANTI-FRICTION DEVICE OF DRILLING ELEMENTS

This application is a National Stage Application of International Application No. PCT/IB2014/064460, filed 12 Sep. 2014, which claims benefit of Serial No. TO2013A000778, filed 30 Sep. 2013 in Italy and which applications are incorporated herein by reference. To the extent appropriate, a claim of priority is made to each of the above disclosed applications.

BACKGROUND OF THE INVENTION

The present invention relates to an anti-friction device, such as, for example, a ring, associated with a drilling element, such as, for example, a drill pipe, a tool joint, or a sub. The device of the present invention is adapted to reduce the sliding, rolling or mixed friction between the drilling element and the walls of the open borehole or the walls of casings during the operating steps.

It is known that, during the drilling operations, said drilling elements generate friction against the borehole walls, especially when drilling wells requiring the use of water-based muds, as opposed to oil-based ones. This problem is particularly felt when drilling deep or extended reach wells.

It is known that, as friction increases, more torque is required from the top drive or rotary table for drilling to be carried out correctly.

According to the latest drilling rig technology, the top drive is preferred over the rotary table for applying drilling torque.

The use of the top drive, due to its very shape, considerably speeds up the steps of inserting and extracting the pipes. Such devices can only withstand a maximum torque value. Should said maximum torque be exceeded, damage may occur to the device itself as well as to the drill pipes.

The friction generated by said drilling elements further increases when drilling deep, deviated or horizontal wells, also known as extended reach wells, where the well target may be offset by more than ten kilometers from the well head.

Systems known in the art try to solve this problem in a passive way by using oil-based drilling muds, which however are being dismissed for environmental reasons, or by having the top drive cooperate with well bottom engines in order to obtain the required torque. The latter solution is not sometimes resolutory, particularly when extended reach wells are involved, and makes for higher running costs.

SUMMARY OF THE INVENTION

The present invention aims at solving said problems by providing an anti-friction device, e.g. a ring of any shape, whether open or closed, and composed of one or more parts, associated with a drilling element such as a drill pipe, a tool joint or a sub, so as to reduce the friction directly acting upon said drilling elements, thereby allowing a reduction of the torque to be applied to the assembly of drilling elements during the drilling operations.

One aspect of the present invention relates to an anti-friction device to be associated with a drilling element.

Auxiliary features of the ring are set out in the appended dependent claims.

BRIEF DESCRIPTION OF THE DRAWINGS

The features and advantages of said ring will become apparent from the following description of three exemplary and non-limiting embodiments thereof and from the annexed drawings, wherein:

FIG. 2A shows it in a closed configuration, and FIG. 2B shows it in an open configuration;

FIG. 3A shows it in a closed configuration, and FIG. 3B shows it in an open configuration;

FIG. 4A shows a front view, and FIG. 4B shows a top view;

FIG. 5A shows a front view, and FIG. 5B shows a top view;

FIG. 6A shows a front view, and FIG. 6B shows a top view;

FIG. 8A shows a generic drilling element, with the housings where the anti-friction devices can be placed, FIG. 8B shows a joint or a sub with which two anti-friction devices are associated, and FIG. 8C shows an end of a drill pipe with which two anti-friction devices are associated.

DETAILED DESCRIPTION OF THE PREFERRED EMBODIMENT(S)

With reference to the above-mentioned Figures, anti-friction device 3 is associated with a drilling element 5.

For the purposes of the present invention, the term "drilling element" refers to any substantially cylindrical device used for drilling an extraction well, which is inserted into the well itself and is subject to rolling and/or sliding friction. By way of non-limiting example, said drilling element may be a drill pipe, a tool joint, or a sub.

Said drilling element 5 has a substantially cylindrical shape, having a first outside diameter "d1" and a longitudinal extension along a first axis "X".

Figure 8A:
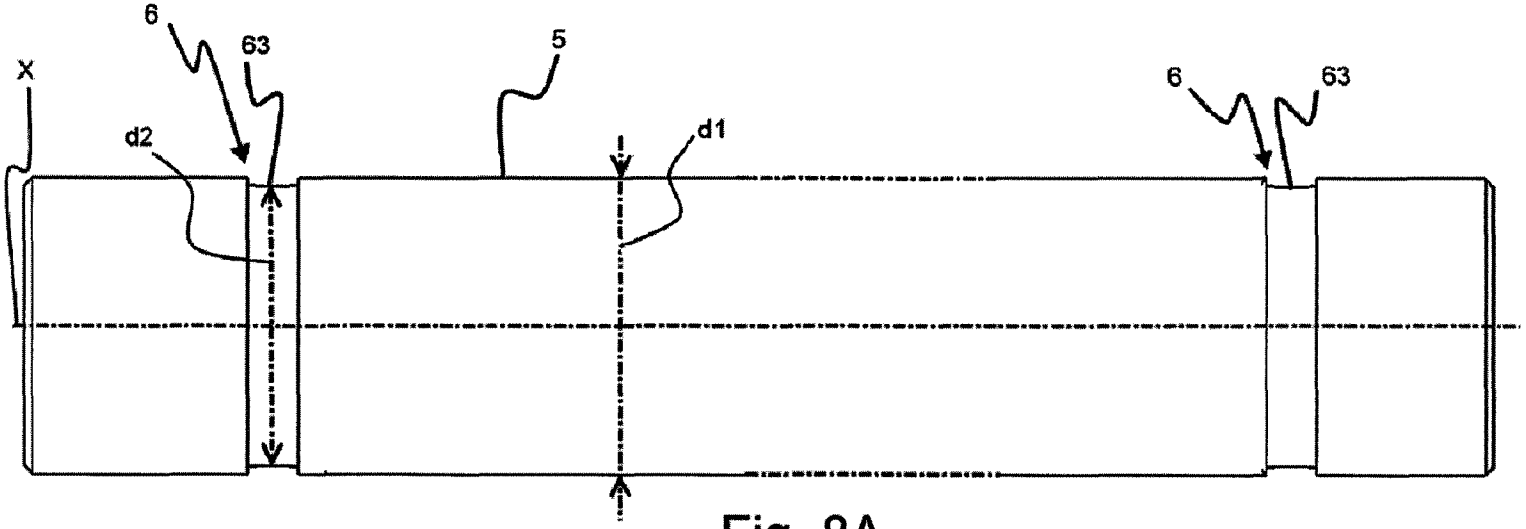
FIGS. 8A, 8B and 8C show a drilling element; in particular.

As is known to those skilled in the art, the longitudinal extension of the single drilling element varies depending on its function during the drilling operations, and has a first outside diameter "d1" of a normally standardized value that also depends on its function during the drilling operations. FIG. 8A shows a generic drilling element with which one or more anti-friction devices according to the present invention can be associated.

Said drilling element 5 comprises a through hole for the passage of drilling mud in normal conditions, and for the passage of service and recovery devices in critical conditions.

Drilling element 5 according to the present invention comprises at least one housing 6 for receiving said anti-friction device 3, as shown by way of example in FIG. 8A.

Anti-friction device 3 according to the present invention has a hollow cylindrical shape having an inside diameter "d" which is smaller than said first diameter "d1" of drilling element 5 and an outside diameter "D" which is greater than said first diameter "d1" of the same drilling element 5.

Anti-friction device 3 according to the present invention is adapted to rotate about said first axis "X" in said housing 6, independently of drilling element 5.

For the purposes of the present invention, the phrase "anti-friction device 3, adapted to rotate independently of drilling element 5" means that said device 3, once it has been associated with drilling element 5, can either rotate together with drilling element 5, at different revolution speeds, or remain stationary. In fact, said device 3, since it abuts on the walls of the open hole of a well and/or of a casing, may get blocked and remain stationary with respect to drilling element 5, which can then continue to rotate with reduced friction.

Preferably, said housing 6 has an inner profile 63, and said anti-friction device 3 has a hollow cylindrical shape comprising an inner surface 31 to be positioned in the proximity of said inner profile 63 and an outer surface 33 for abutting, when in use, on the walls of a drilling well or on the walls of casings.

Anti-friction device 3 according to the present invention, since it has an outside diameter "D" greater than the first outside diameter "d1" of drilling element 5, prevents said drilling element from coming in full contact, at least in principle, with the walls of the casings and with the walls of the open hole of the drilling well.

Said anti-friction device 3, since it has an inner diameter "d" smaller than the first outside diameter "d1" of drilling element 5, can remain at a predetermined height along the longitudinal extension of the same drilling element 5 along the first axis "X". This diameter difference prevents device 3 according to the present invention from moving along the first axis "X".

Preferably, said housing 6 is a groove, and said inner profile 63 defines a second diameter "d2" of the drilling element, which is smaller than said first outside diameter "d1".

In an alternative exemplary embodiment, said housing 6 is made after manufacturing drilling element 5. In a further embodiment, said housing 6 is formed on the outer surface of the drilling element. In this latter embodiment (not shown), the first diameter "d1" is defined by the outer edge of the same housing 6, and inner profile 63 is defined by the outer surface of drilling element 5; the second diameter "d2" is the outside diameter of the same drilling element 5.

The longitudinal extension of housing 6, e.g. the extension of the groove, relative to the first longitudinal axis "X" equals the longitudinal extension between two perimetric portions 35, or bases, of the cylindrical structure comprised in anti-friction device 3, as clearly visible in the annexed drawings.

Said structural characteristics will prevent said anti-friction device 3 from being unintentionally separated from drilling element 5 with which it has been associated.

In the preferred embodiments, e.g. those shown in the annexed drawings, said anti-friction device 3 is a ring, the radial dimensions of which are greater than the longitudinal dimensions relative to the first longitudinal axis "X".

Other shapes of anti-friction device 3 may also be conceived in order to attain the same technical effect, without however departing from the protection scope of the present invention.

In order to further reduce friction and allow said anti-friction device 3 and said drilling element 5 to rotate even more independently about the first axis "X", said inner surface 31 of device 3 according to the present invention has a curved profile for reducing friction against inner profile 63 of housing 6. The reduction of friction between inner surface 31 of device 3 and inner profile 63 allows said device 3 to rotate even more independently of said drilling element 5.

Figure 7:
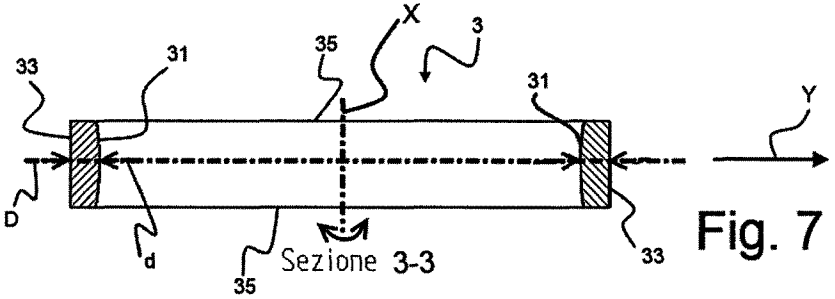
FIG. 7 is a sectional view relative to the plane 3-3 of a generic anti-friction device according to the present invention.

As shown in FIG. 7, inner surface 31 has a convex profile, the thickness of which, with respect to a transversal axis "Y" perpendicular to said first longitudinal axis "X", is greater in the central portion of the longitudinal extension of said anti-friction device 3. This concept is clearly illustrated in said FIG. 7 and is easily comprehensible by a man skilled.

Said curved profile preferably describes a parabolic line.

The device according to the present invention comprises at least one opening portion 37 for allowing said device 3 to be assembled to or disassembled from drilling element 5. Said opening portion 37 allows anti-friction device 3 to take either a closed configuration or an open configuration. Said open configuration of device 3 allows anti-friction device 3 to be installed on and removed from drilling element 5. The closed configuration of anti-friction device 3 allows it to operate, when assembled, and provide friction reduction.

Figure 1:
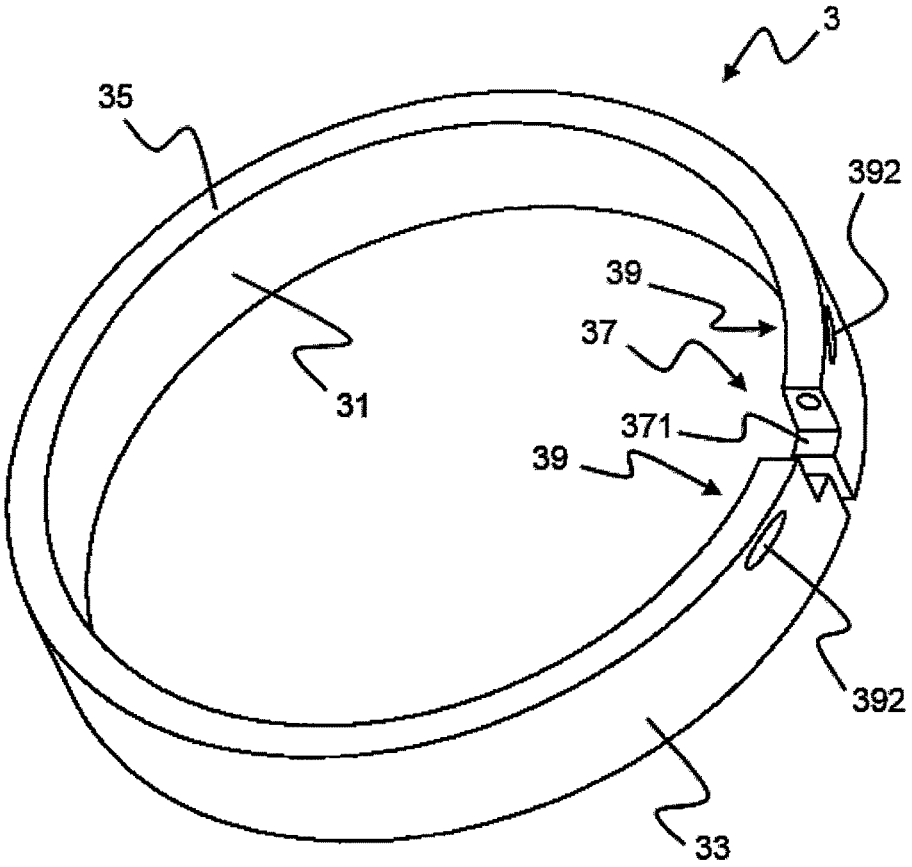
FIG. 1 is a perspective view of a first embodiment of an anti-friction device according to the present invention.
Figure 4A:
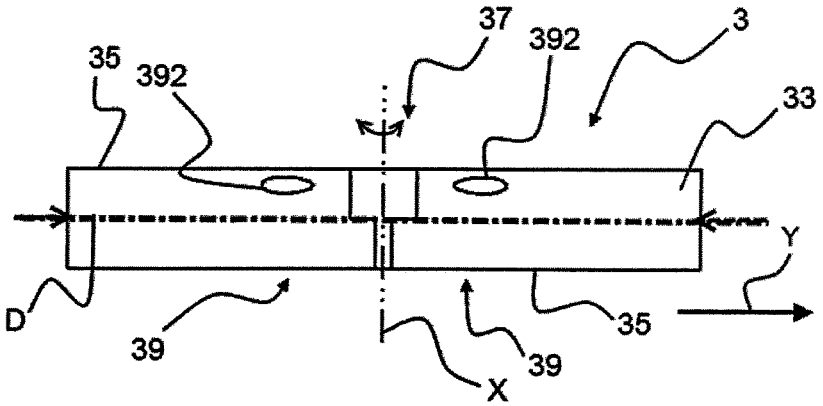
FIGS. 4A, 4B are different views of the device of FIG. 1; in particular.
Figure 4B:
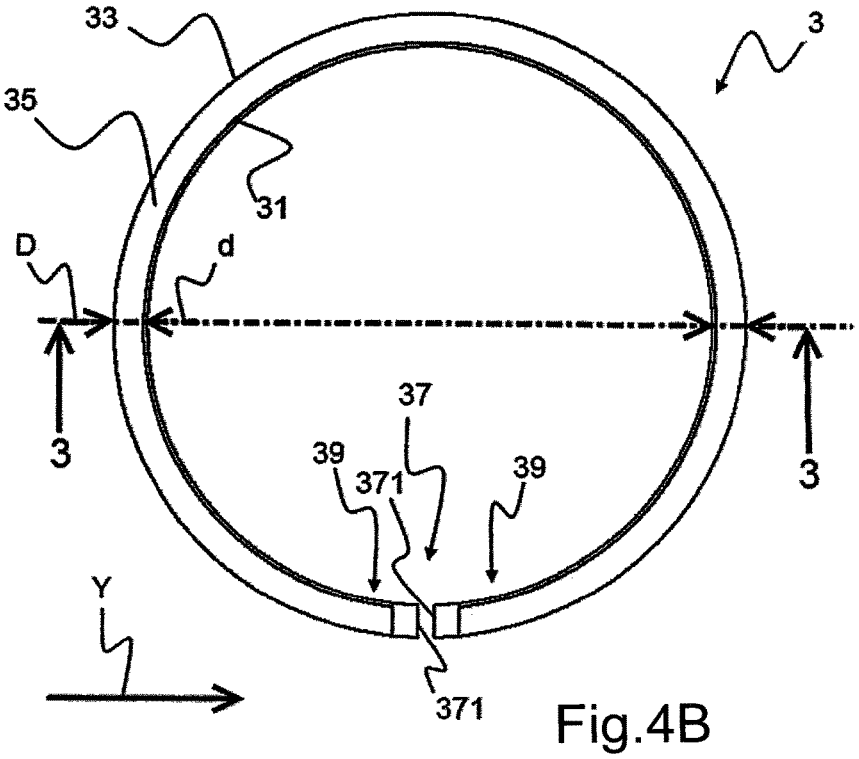

In the first embodiment of the device according to the present invention, as shown by way of example in FIGS. 1, 4A and 4B, said opening portion 37 is a groove extending along the total longitudinal extension of the device itself, as clearly visible in FIGS. 1, 4A and 4B. Said groove defines two ends 371 spaced apart.

Said anti-friction device 3 further comprises at least one interface portion 39. Said interface portion 39 comprises at least one gripping element 392. Said gripping elements 392 are useful for increasing the diameters d, D of said anti-friction device 3.

In particular, a suitable device (not shown) adapted to cooperate with said gripping element 392 of interface portion 39 can, due to the elastic properties of antifriction device 3 itself, pull apart ends 371 of the groove, thereby changing the equivalent diameters of anti-friction device 3.

More in detail, in the first embodiment said device 3 comprises two interface portions 39, each one associated with one end 371 of the groove. More specifically, each interface portion 39 comprises only one gripping element 392, which is a hole into which an opening element (not shown) can be inserted.

In particular, the inherent elasticity of antifriction device 3, given by both its material and its shape, in particular a ring-like shape, allows increasing the equivalent inside diameter so that it will exceed said first diameter "d1" of drilling element 5. Such equivalent diameter variation is such that anti-friction device 3 can be properly positioned in said housing 6 or extracted from the same housing 6.

In the second exemplary and non-limiting embodiment shown in FIGS. 2A, 2B, 5A and 5B, anti-friction device 3 comprises two opening portions 37 that create a first portion 3' and a second portion 3" of said anti-friction device 3.

Said two opening portions 37 are preferably equally spaced apart in order to create a first portion 3' and a second portion 3" having the same size, in particular two semicircumferences describing each an arc of circumference of 180°.

Each one of said first portion 3' and second portion 3" is defined by two ends 371, which ends define opening portion 37. Each opening portion 37 comprises at least one fastening element 372 allowing said first portion 3' and said second portion 3" to be fastened to each other.

Figure 2B:
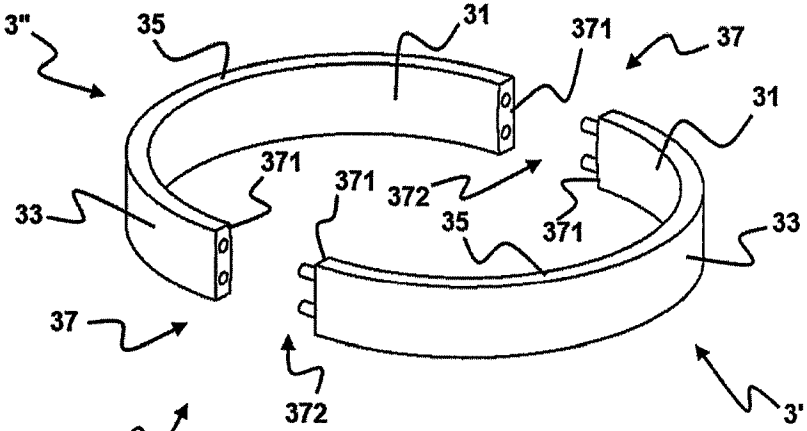
FIGS. 2A and 2B are perspective views of a second embodiment of the anti-friction device; in particular.
Figure 2A:
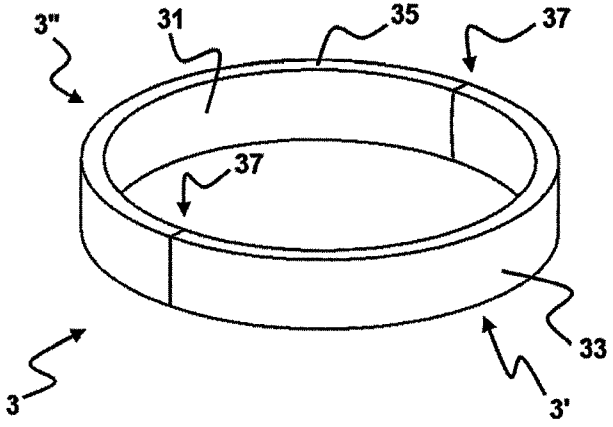
Figure 5A:
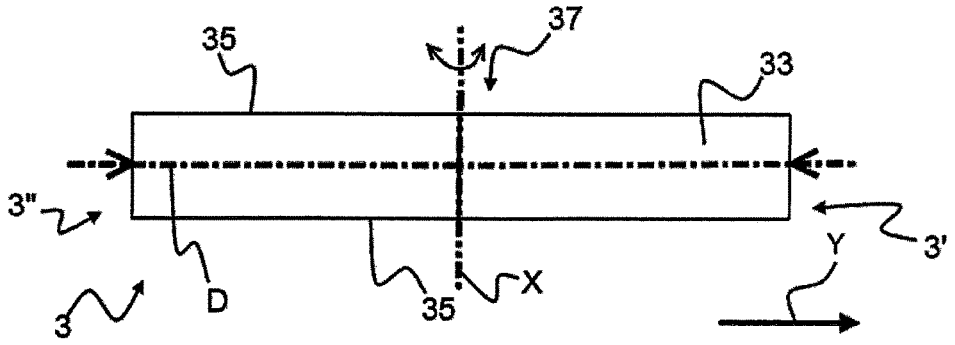
FIGS. 5A, 5B are different views of the device of FIGS. 2A and 2B; in particular.
Figure 5B:
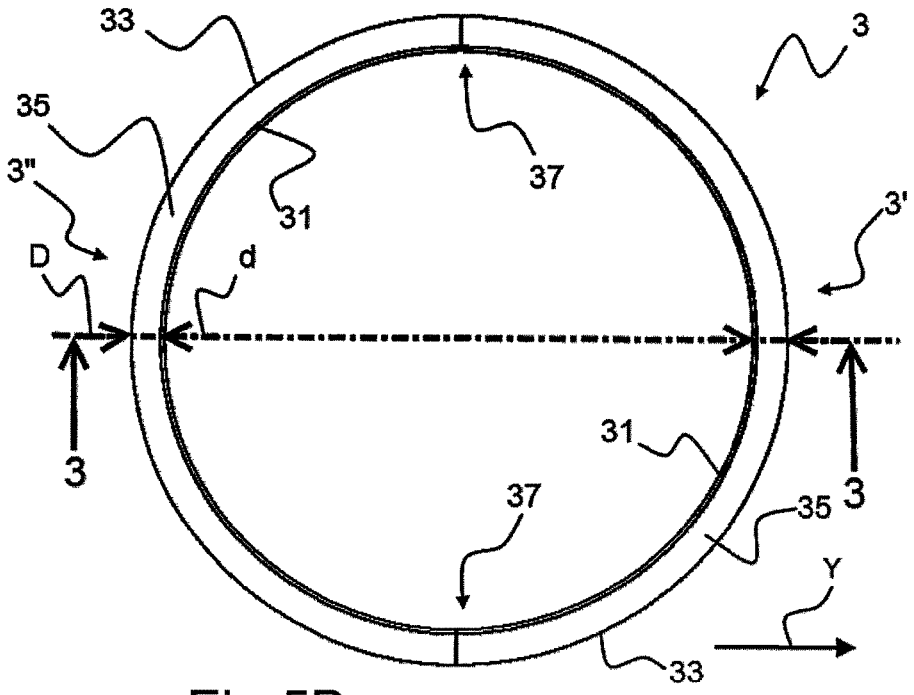

As shown by way of example in FIGS. 2B, 5A and 5B, each opening portion 37 comprises at least one fastening element 372 of the pin-socket type. In this embodiment, of the two ends 371 of one same opening portion 37, one comprises at least one pin and the other one at least one hole complementary to said pin, into which said at least one pin can be inserted. The pin is fastened to the hole by interference fit.

In the second embodiment, as shown by way of example in FIGS. 2B, 5A and 5B, each opening portion 37 comprises two fastening elements 372 of the pin-socket type. More in detail, said first portion 3' comprises at both ends 371 the pins of each fastening element 372 of opening portion 37, while said second portion 3" comprises at both ends 371 the holes of each fastening element 372 of opening portion 37, so that said first portion and said second portion can be fastened together. In other equivalent embodiments not shown herein, each portion 3', 3" comprises at least one pin at one end 371, and at least one hole at the opposite end 371. Further alternative embodiments (not shown), with different configurations of the pin-socket fastener, should be considered to fall within the scope of the present invention.

In the third exemplary and non-limiting embodiment shown in FIGS. 3A, 3B, 6A and 6B, anti-friction device 3 comprises two opening portions 37 that create a first portion 3' and a second portion 3" of said anti-friction device 3.

Said two opening portions 37 are preferably equally spaced apart in order to create a first portion 3' and a second portion 3" having the equivalent size, in particular two semicircumferences describing each an arc of circumference of 180°.

Each one of said first portion 3' and second portion 3" is defined by two ends 371, which ends define the opening portion 37. Each opening portion 37 comprises at least one fastening element 372 allowing said first portion 3' and said second portion 3" to be fastened to each other.

Figure 3B:
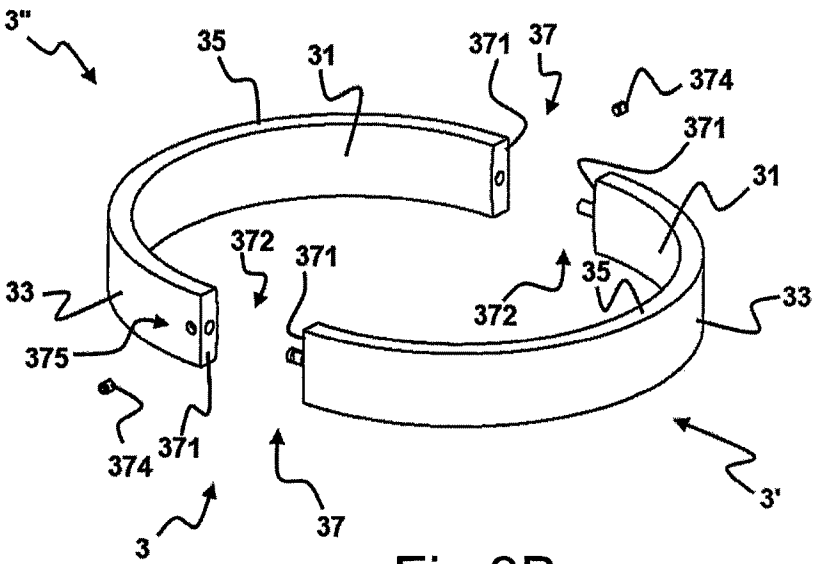
FIGS. 3A and 3B are perspective views of a third embodiment of the anti-friction device; in particular.
Figure 3A:
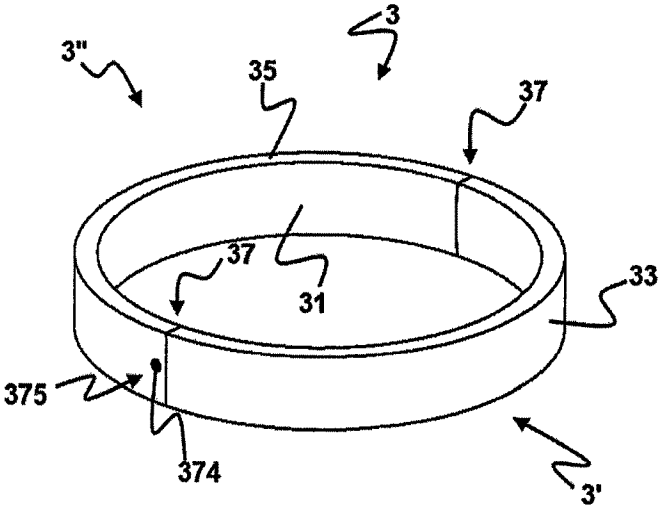
Figure 6A:
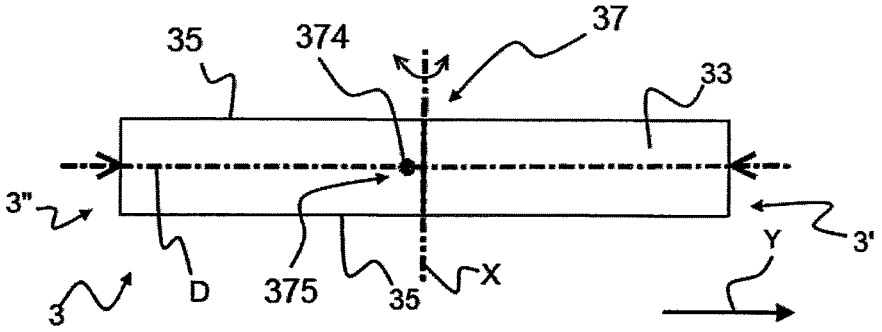
FIGS. 6A, 6B are different views of the device of FIGS. 3A and 3B; in particular.
Figure 6B:
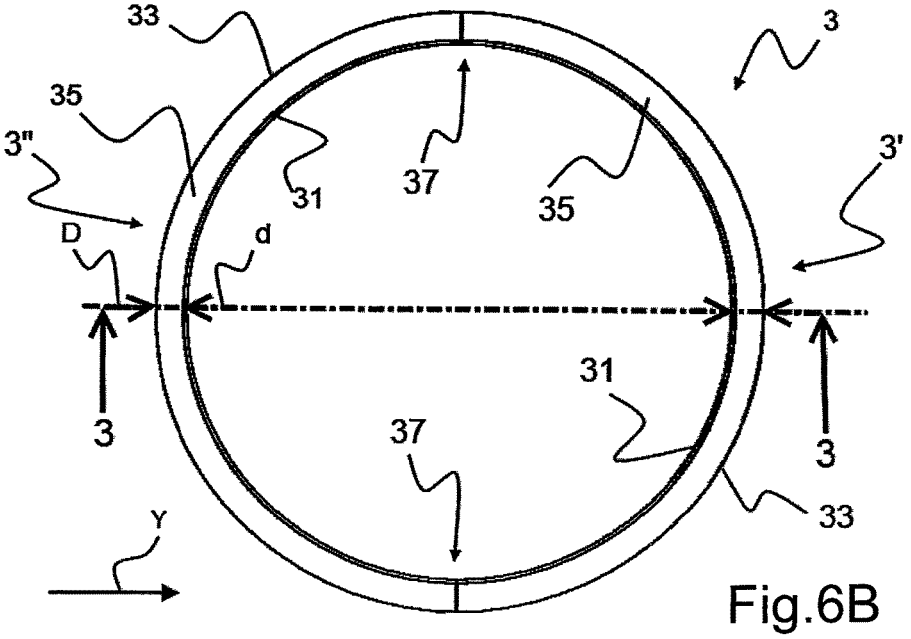

As shown by way of example in FIGS. 3B, 6A and 6B, each opening portion 37 comprises at least one fastening element 372 of the pin-socket type. In this embodiment, of the two ends 371 of one same opening portion 37, one comprises at least one pin and the other one at least one hole complementary to said pin, into which said at least one pin can be inserted. The pin in secured into the hole by means of at least one retaining element 374.

In the third embodiment, shown by way of example in FIGS. 3B, 6A and 6B, each opening portion 37 comprises a fastening element 372 of the pin-socket type with which a retaining element 374 is associated in order to retain said pin within the hole. More in detail, said first portion 3' comprises, at both ends 371, one pin of fastening element 372 of each opening portion 37, while said second portion 3" comprises, at both ends 371, one hole of the fastening element 372 of each opening portion 37; in a position corresponding to each hole, arranged radially thereto, there is a seat 375, which in the exemplary and non-limiting embodiment described herein preferably has a circular geometry and a thread (but may also have different shapes), into which a retaining element 374 is inserted, e.g. a dowel to be screwed into said seat in order to lock the pin within its hole, so that said first portion 3' and said second portion 3" of anti-friction device 3 can be fastened together.

Further alternative embodiments (not shown), with different configurations of the pin-socket fastener, should be considered to fall within the scope of the present invention.

Said second and third embodiments of anti-friction device 3 are similar, in that they allow said device to be divided into two distinct portions 3', 3", while preserving all the functional features of the first embodiment.

In order to switch from the open configuration to the closed configuration and vice versa, said second embodiment and said third embodiment require that, after removal of any retaining elements 374 which characterize the third embodiment, forces be applied in a direction substantially perpendicular to the plane in which opening 37 lies. Where the forces for switching from the open configuration to the closed configuration and vice versa are applied, the portions 3', 3" of device 3 can be considered as interface portions defining a gripping element through which the user can act upon said anti-friction device 3.

Any aspects that are common to both the second and third solutions, which however have not been expressly specified or have been attributed herein to one embodiment only although clearly visible and inferable from the drawings of the second and third embodiments, will have to be considered as included in the present description.

Other equivalent embodiments (not shown) comprising two opening portions 37, wherein one opening portion comprises fastening elements, whereas the other opening portion comprises constraining means such as, for example, yielding means or hinges, for the purpose of increasing the equivalent diameters of anti-friction device 3 without obtaining a first portion 3' separate from and independent of said second portion 3", will have to be considered as falling within the protection scope of the present invention.

In general, said anti-friction device 3 according to the exemplary and non-limiting embodiments described herein is made of steel or carbon fibre, so as to exploit the known characteristics of hardness, rigidity and strength of both such materials. In an equivalent embodiment, device 3 is made of steel treated with sintered carbon and ceramic. In another embodiment, device 3 is made of carbon fibre with a polymeric coating.

In order to ensure that device 3 will rotate correctly in housing 6, and to prevent the edges of said housing 6 from being subject to wear, said housing 6 is subjected to a ceramic or graphite treatment.

Figure 8B:
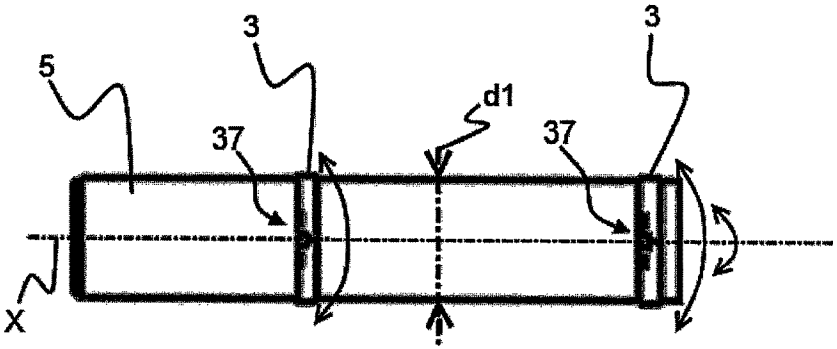
Figure 8C:
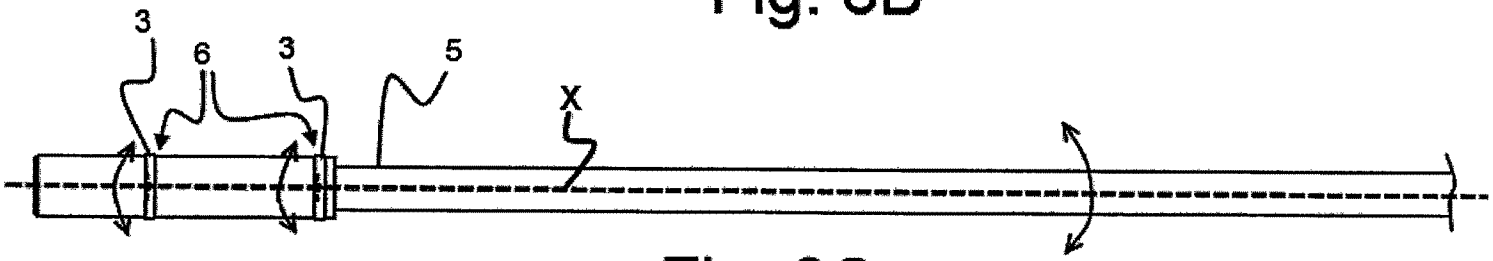

In a first preferred embodiment, said drilling element 5 is a drill pipe, e.g. as shown in FIG. 8C.

In a second preferred embodiment, said drilling element 5 is a tool joint or a sub, e.g. as shown in FIG. 8B.

Preferably, one or two anti-friction devices 3 are associated with each drilling element 5.

By way of non-limiting example, when two devices 3 are used, they shall be arranged in proximity to the ends of the same drilling element 5, e.g. as shown in FIG. 8B. When said devices 3 are three, a third device 3 shall be arranged in a central position on said element 5 in addition to those positioned on the peripheral portions. As the number of devices 3 increases, those exceeding the two positioned at the ends will be arranged at regular or irregular intervals along the longitudinal extension of the same drilling element 5.

In alternative embodiments, the anti-friction devices may have different diameters d, D and longitudinal extensions depending on the shape of said drilling element 5.

A drilling element 5, depending on its structural characteristics, may comprise two or more anti-friction devices 3 having the same outside diameter "D" but a different inside diameter "d".

Device 3 according to the present invention reduces the anomalous wear of drilling elements 5, in that said drilling elements are less subject to friction against the walls of the casing or of the open hole of the drilling well.

Anti-friction device 3 according to the present invention considerably reduces the risk of failure of said drilling elements 5, thereby significantly improving the safety of operations.

Anti-friction device 3 according to the present invention, in addition to reducing the non-productive time (NPT) and improving safety, also allows increasing the drilling speed because of less friction, resulting in lower running costs and earlier production from the well.

Anti-friction device 3 according to the present invention and to the exemplary and non-limiting embodiments presented herein can be used for drilling operations requiring the use of drilling elements 5 such as drill pipes having a nominal diameter "d1" of 5", 5½", 5⅞" or 6⅝". Anti-friction device 3 according to the present invention and to the exemplary and non-limiting embodiments presented herein can be used for drilling operations requiring the use of drilling elements 5 such as tool joints or sub having a nominal diameter "d1" of 6⅝", 7", 7¼", 7½", 8", 8¼" or 8½".

Any variants of anti-friction device 3 conceivable by a man skilled in the art, as well as any application of anti-friction device 3 to drilling elements 5 having nominal dimensions "d1" other than those mentioned above, will have to be considered as falling within in the protection scope of the present invention.

REFERENCE NUMERALS

Anti-friction device 3
First portion 3'
Second portion 3"
Inner surface 31
Outer surface 33
Perimetric portions 35
Opening portion 37
Ends 371
Fastening element 372
Retaining element 374
Seat 375
Interface portion 39
Gripping elements 392
Drilling element 5
Housing 6
Inner profile 63
First diameter "d1"
Second diameter "d2"
Inside diameter "d"
Outside diameter "D"
First axis "X"
Transversal axis "Y"

The invention claimed is:

1. An anti-friction device associated with a drilling element; said drilling element having a substantially cylindrical shape, with a first outside diameter and a longitudinal extension along a first axis; said drilling element comprising:

at least one housing having an inner profile, said housing being adapted to receive said anti-friction device;

said anti-friction device having a hollow cylindrical shape, having an inside diameter which is smaller than said first diameter of the drilling element and an outside diameter which is greater than said first diameter of the drilling element;

said anti-friction device being capable of rotating about said first axis in said housing, independently of the drilling element;

said anti-friction device is a ring, radial dimensions of the ring being greater than longitudinal dimensions relative to a first longitudinal axis;

an inner surface positioned proximate said inner profile;

an outer surface for abutting, when in use, on walls of an open hole of a drilling well or on walls of casings;

wherein said inner surface has a curved profile for reducing friction against the inner profile of the housing.

2. A device according to claim 1, wherein said device comprises at least one opening portion for allowing said device to be assembled to or disassembled from the drilling element.

3. A device according to claim 2, said anti-friction device being monolithic; wherein said opening portion is a groove extending along a total longitudinal extension of the device; said device comprising at least one interface portion comprising gripping elements for increasing equivalent diameters of said anti-friction device.

4. A device according to claim 2, comprising two opening portions comprising a first portion and a second portion of said anti-friction device.

5. A device according to claim 1, wherein said device is made of steel or carbon fibre.

6. A device according to claim 1, wherein said housing comprises a ceramic or graphite treated housing.

7. A device according to claim 1, wherein said drilling element is a drill pipe.

8. A device according to claim 1, wherein said drilling element is a tool joint or a sub.

9. A device according to claim 1, wherein at least two anti-friction devices are associated with each drilling element.

10. A device according to claim 1, wherein the inner surface has a convex profile, the thickness of the convex profile with respect to a transverse axis perpendicular to said first longitudinal axis is greater in a central portion of the longitudinal extension of said anti-friction device.

* * * * *